US007668784B2

(12) United States Patent
Herbert

(10) Patent No.: US 7,668,784 B2
(45) Date of Patent: Feb. 23, 2010

(54) PRINTING OF POSTAL INDICIA AND DETECTION THEREOF

(75) Inventor: Raymond John Herbert, Leigh-on-Sea (GB)

(73) Assignee: NEOPOST Limited, Essex (GB)

( * ) Notice: Subject to any disclaimer, the term of this patent is extended or adjusted under 35 U.S.C. 154(b) by 221 days.

(21) Appl. No.: 09/825,285

(22) Filed: Apr. 4, 2001

(65) Prior Publication Data

US 2001/0056408 A1 Dec. 27, 2001

(30) Foreign Application Priority Data

Apr. 5, 2000 (GB) ..... 0008180.2

(51) Int. Cl.
*G06Q 99/00* (2006.01)

(52) U.S. Cl. ..... 705/62; 705/60; 705/61; 705/401; 705/410

(58) Field of Classification Search ..... 705/400, 705/1, 60–63, 401–410; 235/437, 454
See application file for complete search history.

(56) References Cited

U.S. PATENT DOCUMENTS

| | | | | |
|---|---|---|---|---|
| 3,935,429 | A * | 1/1976 | Branecky et al. | 235/454 |
| 4,141,492 | A * | 2/1979 | Michel et al. | 235/437 |
| 4,829,568 | A | 5/1989 | Clark et al. | |
| 5,683,190 | A * | 11/1997 | Gawler | 400/582 |
| 5,699,257 | A * | 12/1997 | Emmett et al. | 705/408 |
| 5,907,833 | A * | 5/1999 | Lee | 705/410 |
| 6,311,892 | B1 * | 11/2001 | O'Callaghan et al. | 235/375 |
| 7,069,247 | B1 * | 6/2006 | Oppedahl | 705/62 |

FOREIGN PATENT DOCUMENTS

| | | |
|---|---|---|
| EP | 0714777 | 6/1996 |
| EP | 0871145 | 10/1998 |
| EP | 0938066 | 8/1999 |

OTHER PUBLICATIONS

Tygar et al., Cryptogrpahic Postage Indicia, Jan. 1996.*
"Information Based Indicia Program (IBIP) Indicium Specification", Jun. 13, 1996.

* cited by examiner

*Primary Examiner*—Jalatee Worjloh
(74) *Attorney, Agent, or Firm*—Sughrue Mion, PLLC

(57) ABSTRACT

The invention provides a method of detection of an imprint of a postal indicium at a location on a mail piece. The method involves utilizing a sensor to scan along a band on the mail piece to detect a sequence of transitions between light and dark reflectance areas within a band extending across the said location. AN indication of the presence of the imprint of the postal indication is generated in response to detection of a transition succeeding a predetermined number of initial transitions at a start of the sequence of transitions.

The invention also provides apparatus for imprinting postal indicia on mail pieces. The apparatus comprises a printer operable to print a postal indicium in a required location on the mail piece. A first sensor is provided that is responsive to reflectance transitions between light and dark along a band of the mail piece extending across the said location. The first sensor generates a sequence of first signals corresponding respectively to reflectance transitions along the said band. The apparatus further includes means operative in response to a first signal occurring after a predetermined number of said first signals at a start of said sequence to generate a second signal which is indicative of a postal indicium imprint on the mail piece.

7 Claims, 2 Drawing Sheets

PRINTING OF POSTAL INDICIA AND DETECTION THEREOF

The present invention relates to detection of printing of postal indicia that provide evidence of accounting for postage charges dispensed by postage metering apparatus in respect of mail pieces on which the indicia are printed.

Generally in postage metering apparatus, and in particular in respect of postage metering apparatus capable of handling large numbers of mail pieces, mail pieces are fed by mail feeding means past a print head that is operated to print a postal indicium on each mail piece. The postal indicium contains a value of postage charge dispensed in respect of the mail piece and other postage information, for example an identification of the postage metering apparatus, the date, a mail piece count of mail pieces processed by the apparatus and class of mail. In order to permit verification of the authenticity of postage information contained in the postage indicium, the postage indicium includes cryptographic information which may include a digital signature or the result of encryption of at least some of the postage information. The postage metering apparatus is operated in such manner that the postage indicium is printed on the mail piece only when accounting has been effected in respect of the postage charge relating to that mail piece. Accordingly the postage indicium printed on the mail piece provides evidence that accounting has been effected in respect of the postage charge for that mail piece.

It will be appreciated that there may be a failure in operation of a printing device subsequent to accounting for a postage charge and as a result a mail piece, for which accounting in respect of the postage therefor has been effected, may not receive an imprint of the postage indicium. As a result, from inspection of the mail piece, it will appear that a postage charge has not been applied and accounted for whereas accounting has been effected but printing of the postal indicium has failed. It is desirable that mail pieces which have not received an imprint of the postal indicium do not enter the mail stream for delivery to the postal authority. Therefore it is desired to provide means that is responsive to the presence or absence of a printed indicium on a mail piece and provides an indication in relation to any mail piece that does not receive an imprint of the postal indicium.

According to one aspect of the invention a method of detection of an imprint of a postal indicium at a location on a mail piece comprises the steps of utilising a sensor to scan along a band on the mail piece to detect a sequence of transitions between light and dark reflectance areas within said band, said band extending across said location; generating an indication of presence of the imprint of the postal indication in response to detection of a transition succeeding a predetermined number of initial transitions at a start of the sequence of transitions.

According to a second aspect of the invention apparatus for imprinting postal indicia on mail pieces includes printing means operable to print a postal indicium in a required location on the mail piece; a first sensor responsive to reflectance transitions between light and dark along a band of the mail piece extending across said location to generate a sequence of first signals corresponding respectively to reflectance transitions along said band; means operative in response to a first signal occurring after a predetermined number of said first signals at a start of said sequence to generate a second signal indicative of a postal indicium imprint on the mail piece.

An embodiment of the invention will now be described by way of example with reference to the drawings in which.

Figure 1:
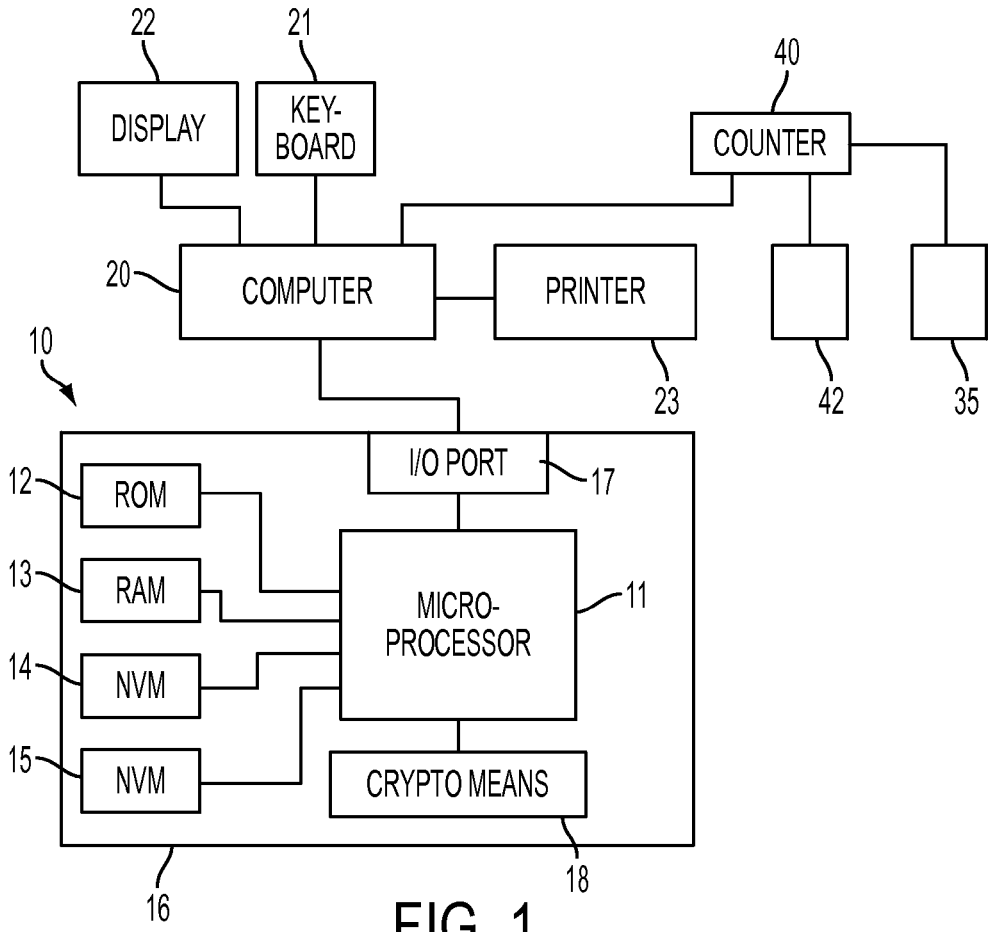
FIG. 1 is a block diagram of mail processing apparatus.

Referring first to FIG. 1 mail processing apparatus includes a postal secure device (PSD) 10 operable to carry out accounting in respect of dispensing of postage charges in relation to mail items. The PSD 10 includes electronic accounting means comprising a micro-processor 11 operating under program routines stored in a read only memory (ROM) 12. A random access memory (RAM) 13 is provided for use as a working store for temporary storage of data during operation of the PSD. Non-volatile duplicated memories 14, 15 are provided for the storage of critical data relating to use of the PSD and in particular for storage of accounting data relating to dispensing of postage charges which is required to be retained even when the PSD is not powered. The microprocessor 11 carries out accounting functions in relation to dispensing postage value in respect of amounts of postage charges applicable to handling of mail items by a postal authority or other carrier. The accounting data usually includes a value of credit, an accumulated total of value dispensed by the PSD in respect of mail pieces, a count of the number of mail pieces processed by the PSD and a count of the number of mail pieces for which a postage charge in excess of a predetermined value has been dispensed. The value of credit may be a value of credit available for use by the PSD and stored in a descending credit register. The accumulated total value is stored in an ascending tote register, the count of items is stored in a piece count register and the count of items to which a postage charge in excess of a predetermined value is applied is stored in a large items register. Alternatively, if desired, instead of a descending register storing a value of credit available for use by the PSD, a total value of credit entered into the PSD may be stored in an ascending credit register.

As is well known in the postage meter art, each of the registers referred to hereinbefore for storing accounting data is replicated in order to enable integrity of the accounting data to be maintained even in the event of a fault or termination of power to the PSD during operation of the mail handling apparatus. Two replications of each of the registers are provided in each of the memory devices 14, 15. The components of the PSD are housed in a secure housing 16 to provide security against unauthorised tampering with the components of the PSD.

External communication with the micro-processor 11 of the PSD is effected by means of an input/output port 17 connected to the microprocessor.

Control of operation of the PSD is effected by means of a computer 20 communicating via the input/output port 17. The computer 20 is provided with a keyboard 21 for the input of information by an operator of the mail handling apparatus and with a display 22 for display of information to the operator.

Figure 2:
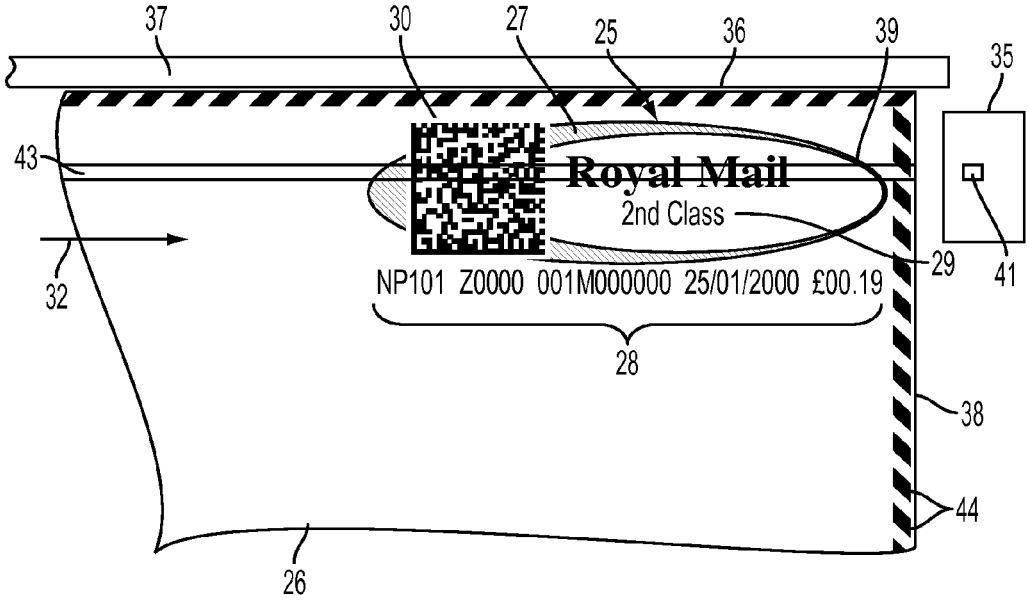
FIG. 2 illustrates a part of a mail piece and the location thereof in relation to means for sensing a printed postal indicium thereon.

A printer 23 is operated under control of the computer 20 to print postal indicia 25 as shown in FIG. 2 on mail items 26. The postal indicia is of a form authorised by the postal authority and comprises a graphic design 27 and postal data 28. The postal data includes a value of postage applied to the mail item, the date of processing the mail piece, postage meter identification, a mail piece count. The postal indicia may also include class of mail 29. The postal indicia also includes cryptographic data, for example a digital signature or encryption of data, to enable authenticity of the postal indicia to be verified. Cryptographic means 18 are provided in the PSD for the generation of the cryptographic data to be printed on the mail pieces. The cryptographic data is generated from the postage data included in the postal indicium whereby the cryptographic data printed on the mail piece may be utilised to verify the postage data printed in the postal indicium. The encrypted information may be truncated. The cryptographic means may include hardware separate from the micro-processor arranged to generate digital signatures or to encrypt information or may be implemented by the microprocessor 11 operating under software routines to generate digital signatures or to encrypt information.

The postal indicium also includes an area 30 in which the postal data is printed in machine readable 2D or datamatrix form. The cryptographic data is printed in 2D or datamatrix form in the area 30 so as to be machine readable for input to a verification system.

The computer 20 is operated under control of a postage metering program routine and inputs, to the PSD, postal data including at least an amount of postage charge to be applied in respect of a mail item to the PSD 10. The PSD carries out accounting functions in respect of the postage charge to be applied to the mail piece and then the PSD outputs postage data including the cryptographic data to the computer. The computer then operates to control operation of the printer to print the postal indicium including postal data and cryptographic data on the mail piece.

It will be appreciated that accounting in respect of the postage charge to be applied to the mail piece is effected by the PSD prior to printing of the postal indicium on the mail piece by the printer 23. Accordingly if the printer fails to print the postal indicium on the mail piece, the credit amount in the PSD will have been decremented by the amount of the postage charge but no evidence of accounting for the postage charge is printed on the mail piece. If this mail piece is maintained in the mail stream and is received by the postal authority it will appear to the postal authority that a postage charge has not been applied to the mail piece. Accordingly it is desirable to provide at least an indication in respect of any mail piece that does not receive an imprint of the postal indicium so that any mail pieces which do not receive an imprint of a postal indicium can be removed from the mail stream before receipt thereof by the postal authority.

Figure 3:
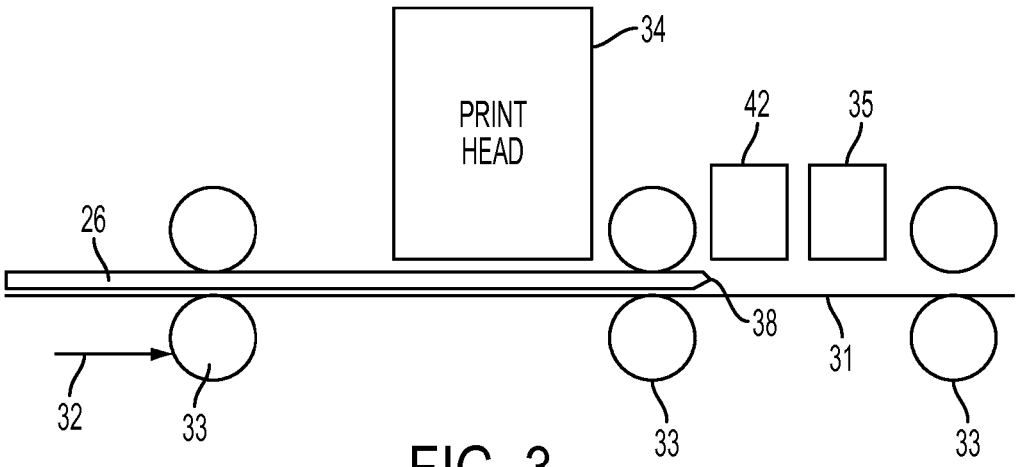
FIG. 3 illustrates means for feeding a mail piece past a print head and for sensing of the postal indicium printed on the mail piece in the mail processing apparatus.

Referring to FIG. 3, mail pieces 26 are fed along a feed bed 31 in the direction of arrow 32, by pairs of feed rollers 33, past a print head 34 of the printer 23. A print sensor 35 is provided at a location downstream of the print head 34. During feeding of the mail item along the feed bed, an upper edge 36 is fed in engagement with a guide 37 (see FIG. 2). The print sensor 35 is responsive to light reflected from an area 41 and is located relative to the guide 37 such that a narrow band, indicated by reference 43, of the mail piece is scanned by the print sensor. The print sensor is a reflective contrast sensor set to monitor the contrast ratio between light reflected from an area of ink deposited on the surface of the mail piece and light reflected from a background area of the surface of the mail piece which has not received ink. The area 41 to which the sensor 35 is responsive is illuminated by a light source (not shown). The light source may emit white light or may emit coloured light. The colour of the light emitted may be selected in dependence upon the colour of mail pieces being processed and upon the colour of the ink used for printing the postal indicium in order to provide an optimum contrast ratio between the areas in which ink is deposited and areas in which no ink is deposited. Levels representing light required to be reflected from an ink area and light required to be reflected from a background area are stored as reference levels.

As the mail piece passes the print head, the print head is operated to print the postal indicium on the mail piece. After receiving the imprint of the postal indicium, the mail piece passes the print sensor 35. During passage of the mail piece past the print sensor, the print sensor output is compared with the reference levels for ink and background areas. Change of the output of the sensor within a defined tolerance from a level corresponding to the background reference level to a level corresponding to the ink reference level indicates detection of a transition from light to dark.

Passage of a leading edge 38 of the mail piece past the print detector may result in the print detector detecting a transition from light to dark. Further transitions from light to dark will be detected if the mail piece has pre-printed markings, for example edge markings indicated at 44 such as are provided on envelopes intended for air mail use, that extend in the band 36 sensed by the print detector. During further feeding of the mail piece, the imprint of the postal indicium passes the print detector and a transition from light to dark will be detected in respect of each ink area of the postal indicium that extends in the band 36.

It will be appreciated that detection of light to dark transitions due to the leading edge of the mail piece and due to pre-printed markings do not result from the postal indicium imprint and are false indications as regards detection of an imprint of the postal indicium on the mail piece. Accordingly means are provided to render such false indications ineffective in relation to detection of the postal indicium imprint. Conveniently such means may be implemented by a counter 40 that is incremented by the output of the print sensor. An output of the counter is connected to the computer and provides an output signal to the computer when the count in the counter has been incremented to a predetermined count by the output from the print sensor.

It has been found that a predetermined count of 3 is usually suitable but other counts may be used depending for example upon the presence of pre-printed markings on the mail pieces. With a mail piece as illustrated in FIG. 3 with an edge marking and assuming that the print sensor detects the leading edge of the mail piece and with the counter set to produce an output signal on a predetermined count of 3, outputs from the print sensor in respect of the leading edge of the mail piece and the edge marking are rendered ineffective and an output signal is produced by the counter when the graphical outline 39 of the postal indicia is detected. Accordingly no output signal is produced by the counter in respect of the false indications resulting from sensing of the leading edge of the mail piece and the edge marking. Hence the counter produces an output signal only when the postal indicium imprint passes the print sensor. It will be appreciated that the imprint of the postal indicium includes a plurality of ink areas extending in the band 36. Accordingly if the leading edge of the mail piece does not result in detection of a transition by the print sensor or if there is no pre-printed marking on the mail piece ink areas other than of the graphical outline of the postal indicium will result in an output from the counter. Also if the predetermined count is set to a count greater than 3, an ink area other than of the graphical outline will result in an output signal from the counter. For example if the predetermined count is set to a count of 7, the counter will produce an output signal when the right hand segment of the character "M" is sensed. The value of the predetermined count may be preset in the mail handling apparatus but if desired the count may be set to a value selected by an operator of the mail handling apparatus.

The output signal from the counter is input to the computer to provide an indication that an imprint of the postal indicium has been detected on the mail piece. If the computer does not receive the output signal from the counter during processing of a mail piece, the computer operates the display to provide information to the operator of the mail handling apparatus that a mail piece that has been fed through the printer has not received a postal indicium imprint. The computer may stop feeding of subsequent mail items by the mail handling system to enable the operator to investigate the failure of the system to print a postal indicium on the mail piece. The information displayed to the operator may include an indication of an item number of the mail piece that has not received the postal indicium imprint.

A reset sensor 42 is located upstream of the print sensor 35 between the print sensor and the print head. The reset sensor detects the leading edge 38 of the mail piece and the resultant output of the reset sensor is used to trip a monoostable circuit to produce a short pulse to reset the counter. Thus, prior to any part of a mail piece being sensed by the print sensor, the reset sensor produces an output that resets the counter to zero and the counter is incremented subsequently from zero by outputs of the print sensor.

In the embodiment described hereinbefore the mail piece, after passing the print head to receive an imprint of a postal indicium, is fed past stationary print and reset sensors to detect whether the mail piece has actually received the imprint. However if desired the mail piece may be held stationary and the print and reset sensors may be traversed over the mail piece. Also the print head may be mounted on a carriage which traverses the mail piece and be operated during the traverse to print the postal indicium. The print sensor and the reset sensor may be mounted on the carriage adjacent the print head so as to follow the print head in the traverse of the mail piece and to scan the mail piece to detect the presence of an imprint of the postal indicium on the mail piece.

Hereinbefore, the print sensor has been described as responding to light to dark transitions however it will be appreciated that the print sensor may respond to dark to light transitions.

In FIG. 1, the counter is shown as a hardware element receiving inputs from the print sensor and the reset sensor and outputting an output signal to the computer. However it should be appreciated that the counter may be implemented by software in the computer 20 in which case the outputs from the print and reset sensors are input to the computer and the computer program routine includes a sub-routine to generate a count resulting from the inputs from the print sensor and the computer responds to failure of the generated count to reach the predetermined value to operate the display to display an indication that no imprint of the postal indicium has been detected and if desired to stop further handling of mail pieces by the system.

Although the detection of imprints of postal indicia has been described in relation to a printer controlled by a computer to which a PSD is connected, the method of detection may be utilised to detect that a postal indicium has been printed on mail piece by the printer of a postage meter. Postage meters include secure accounting means similar to that of the PSD and a printer that is controlled by the accounting means to print postal indicia on the mail pieces. The print sensor and reset sensors are located downstream of the printer of the postage meter and a counter driven by the print sensor and reset by the reset sensor generates an indication of the detection of the postal indicium imprint as described hereinbefore.

Instead of providing a reset sensor that is responsive to detection of a reflectance transition to reset the counter for each mail piece, the counter may be reset by other means responsive to feeding of a mail piece along the feed bed.

What is claimed is:

1. A method of detecting an imprint of a postal indicium at a location on a mail piece, comprising the steps of:

feeding a mail piece along a feed bed;

utilizing a sensor to scan along a band on the fed mail piece to detect a sequence of transitions between areas of light and dark reflectance within the band, the band extending across the location; and generating an indication of a presence of the imprint of the postal indicium in response to detection of a transition succeeding a predetermined number of initial transitions at a start of the sequence of transitions.

2. A method according to claim 1, wherein the postal indicium includes an area in which postal data is printed in machine readable, two dimensional or data matrix form.

3. A method according to claim 1, wherein the postal indicium includes cryptographic data.

4. A method of processing mail, comprising the steps of:

feeding a mail piece along a feed bed;

printing a postal indicium on the fed mail piece using a print head; and subsequently detecting the imprint of the postal indicium on the fed mail piece using detection means, the detection means scanning a band on the fed mail piece to detect a sequence of transitions between areas of light and dark reflectance within the band, and generating an indication of a presence of the imprint of the postal indicium in response to detection of a transition succeeding a predetermined number of initial transitions at a start of the sequence of transitions.

5. A method according to claim 4, further comprising the step of:

stopping the feeding of further mail pieces past the print head in the event that no postal indicium is detected on the fed mail piece.

6. Apparatus for imprinting postal indicia on mail pieces, comprising:

feeding means for feeding a mail piece along a feed bed;

printing means operable to print a postal indicium in a required location on the fed mail piece;

a first sensor responsive to reflectance transitions between areas of light and dark reflectance along a band of the fed mail piece extending across the location to generate a sequence of first signals corresponding respectively to reflectance transitions along the band; and means operative in response to a first signal occurring after a predetermined number of the first signals at a start of the sequence to generate a second signal indicative of an imprint of the postal indicium on the fed mail piece.

7. Apparatus according to claim 6, further comprising:

a second sensor upstream of the first sensor and between the first sensor and a printing head of the printing means, wherein the second sensor is a reset sensor linked to a counter for counting the number of the first signals, and configured to detect a leading edge of each fed mail piece and produce a signal to reset the counter.

* * * * *